United States Patent [19]

Schwarz

[11] 4,366,453

[45] Dec. 28, 1982

[54] ORTHOGONAL MODE TRANSDUCER HAVING INTERFACE PLATES AT THE JUNCTION OF THE WAVEGUIDES

[75] Inventor: Helmut Schwarz, Satellite Beach, Fla.

[73] Assignee: Harris Corporation, Melbourne, Fla.

[21] Appl. No.: 226,092

[22] Filed: Jan. 19, 1981

[51] Int. Cl.[3] ..... H01P 5/16

[52] U.S. Cl. ..... 333/117; 333/125; 333/21 A

[58] Field of Search ..... 333/21 R, 21 A, 117, 333/122, 125, 137

[56] References Cited

U.S. PATENT DOCUMENTS

| | | | |
|---|---|---|---|
| 2,364,371 | 12/1944 | Katzin | 333/21 A X |
| 2,506,418 | 5/1950 | Gilmer et al. . | |
| 2,766,430 | 10/1956 | Zaleski | 333/21 A X |
| 2,923,895 | 2/1960 | Curtis et al. | 333/125 X |
| 3,089,102 | 5/1963 | Rowland . | |
| 3,932,822 | 1/1976 | Salzberg . | |

*Primary Examiner*—Paul L. Gensler

*Attorney, Agent, or Firm*—Antonelli, Terry & Wands

[57] ABSTRACT

In orthogonal mode transducers, typically a first rectangular waveguide capable of carrying a signal having a first polarization and a second rectangular waveguide capable of carrying a signal having a second polarization orthogonal to the first polarization are coupled to a common central waveguide which is capable of carrying signals having both the first and second polarizations. However, in the past, difficulties have been encountered in manufacturing such orthogonal mode transducers because of the necessity of matching these respective waveguides which do not have the same cross-sectional shape and which must be oriented in a particular manner relative to one another to achieve the desired result. To overcome this difficulty in manufacturing, the present invention couples the first and second rectangular waveguides to the central waveguide so that the longitudinal axes of the first and second rectangular waveguides are symmetrically arranged relative to the longitudinal axis of the central waveguide to form a symmetrical Y-configuration.

11 Claims, 2 Drawing Figures

ORTHOGONAL MODE TRANSDUCER HAVING INTERFACE PLATES AT THE JUNCTION OF THE WAVEGUIDES

FIELD OF THE INVENTION

This invention relates generally to waveguide transmission devices, and, more particularly, to an improved orthogonal mode transducer.

BACKGROUND OF THE INVENTION

In the area of microwave engineering, a variety of coupling devices are known for combining two or more microwave signals in a common waveguide. One particularly useful device for such signals is the orthogonal mode transducer. Essentially, orthogonal mode transducers provide for either combining or separating signals which are orthogonal to one another. Typically, this is done using a pair of rectangular waveguide arms coupled to a common waveguide arm in such a fashion that the cross-sections of the rectangular arms are perpendicular to one another.

Orthogonal mode transducers are used in a variety of communication arrangements. One common use for such orthogonal mode transducers is to apply signals of the same frequency which are polarized orthogonally with respect to one another to the rectangular arms for combination in the central arm which is capable of supporting both orthogonal polarizations. Thus, the central arm will carry a combined signal having components which are orthogonally polarized to each other. Such a device is useful for signal transmission. On the other hand, the orthogonal mode transducer can be used to receive at the common arm a signal having a pair of orthogonally polarized components. In this case, the signal would then be separated into its orthogonal components by the rectangular arms, each of which is dimensioned to support only one of the orthogonal components of the received combined signal.

Another common use for orthogonal mode transducers is in transmit-receive systems using a transmitted signal which is polarized orthogonally to the received signal, and which has a different frequency than the received signal. This latter use is especially common in satellite communication systems wherein signals are transmitted to the satellite on the up-link at one frequency and received on the down-link at a different frequency which is polarized orthogonally relative to the transmitted wave.

In the past, most orthogonal mode transducers have been constructed in a general T-configuration. This is typically done in one of two ways. The most common approach is to utilize a linear arrangement between one of the rectangular waveguides and the common waveguide with the orthogonal rectangular waveguide feeding into the common waveguide at a right angle. Thus, the common waveguide and the first rectangular waveguide form the crossbar of the T-configuration while the second rectangular waveguide forms the base of the T.

Another T-configuration is an arrangement wherein the rectangular arms form the top bar of the T while the common arm forms the base of the T. Salzberg U.S. Pat. No. 3,932,822 is an example of such an arrangement.

Although such systems are in common use, they suffer from the basic practical problem of difficulty of construction. Because of the requirements of matching arms properly for the desired wave propagation, it is difficult to properly construct a basic T-configuration to result in a simple and yet structurally strong structure.

Another problem with the types of orthogonal mode transducers discussed above is the amount of space which they occupy due to their configuration. For example, if a linear arrangement is used, a taper is required between the rectangular arm and the common arm which is in line with the rectangular arm. The other rectangular arm is connected to this tapered portion. Due to this arrangement, the length of the device is disadvantageously long.

In systems of the type shown in Salzberg, on the other hand, the perpendicular T-arrangement requires the use of 90° bends at the ends of the rectangular arms in order to couple these rectangular arms to other transmission lines in the system. This occupies a great deal of width. Thus, it can be seen that both prior types of systems occupy a large amount of space and, thus, are not well suited for situations where space is at a premium.

U.S. Pat. No. 3,089,102 to Rowland illustrates one attempt to depart from the conventional T-configuration to obtain a strong rigid structure which has good separation characteristics between a transmitted wave and a received wave. Essentially, this patent shows a modification of the standard T orthogonal mode transducer of the type wherein the common waveguide (in this case a square waveguide) and one of the rectangular waveguides form the top bar of the T. However, rather than having the other rectangular waveguide form the base of the T, as is conventional, the Rowland patent has the second rectangular waveguide branching off from the square waveguide and the first rectangular waveguide at an angle other than 90°. Thus, the result is a type of asymmetric Y-configuration with the square common waveguide forming its base and the two rectangular waveguides forming an asymmetrical top portion.

Although the above-described Rowland system does provide good structural strength, it is still rather difficult to manufacture it due to its asymmetric configuration. For example, a special transition flare section for converting one of the rectangular waveguides to a square waveguide is necessary while permitting coupling of the second rectangular waveguide at an angle. This creates manufacturing difficulties and also adds to the length of the device. Also, the asymmetrical arrangement of the rectangular arms creates bandwidth limitations which give poor overall response. This is particularly true if the orthogonal mode transducer is coupled to a waveguide having high order mode capabilities.

SUMMARY OF THE INVENTION

It is, therefore, an object of the present invention to provide a structurally strong orthogonal mode transducer which can be easily manufactured.

Another object of the present invention is to provide an orthogonal mode transducer which does not give rise to undesired bandwidth limitations particularly when coupled to waveguides having high order mode capabilities.

Yet another object of the present invention is to provide an orthogonal mode transducer which is more compact than conventional orthogonal mode transducers.

With these and other objects in view, the present invention contemplates an orthogonal mode transducer having a central waveguide capable of propagating signals having first and second orthogonal polarizations, a first rectangular waveguide capable of propagating signals having the first polarization but not those having the second polarization, and a second rectangular waveguide capable of propagating signals having the second polarization but not those having the first polarization. In particular, these first and second rectangular waveguides are coupled to a central waveguide in such a manner that the longitudinal axes of the first and second rectangular waveguides are symmetrically arranged relative to the longitudinal axis of the central waveguide to form a symmetrical Y-configuration.

BRIEF DESCRIPTION OF THE DRAWINGS

Other objects and advantages of the present invention may be more clearly understood by reference to the following detailed description and drawings, wherein.

DETAILED DESCRIPTION OF THE PREFERRED EMBODIMENTS

Figure 1:
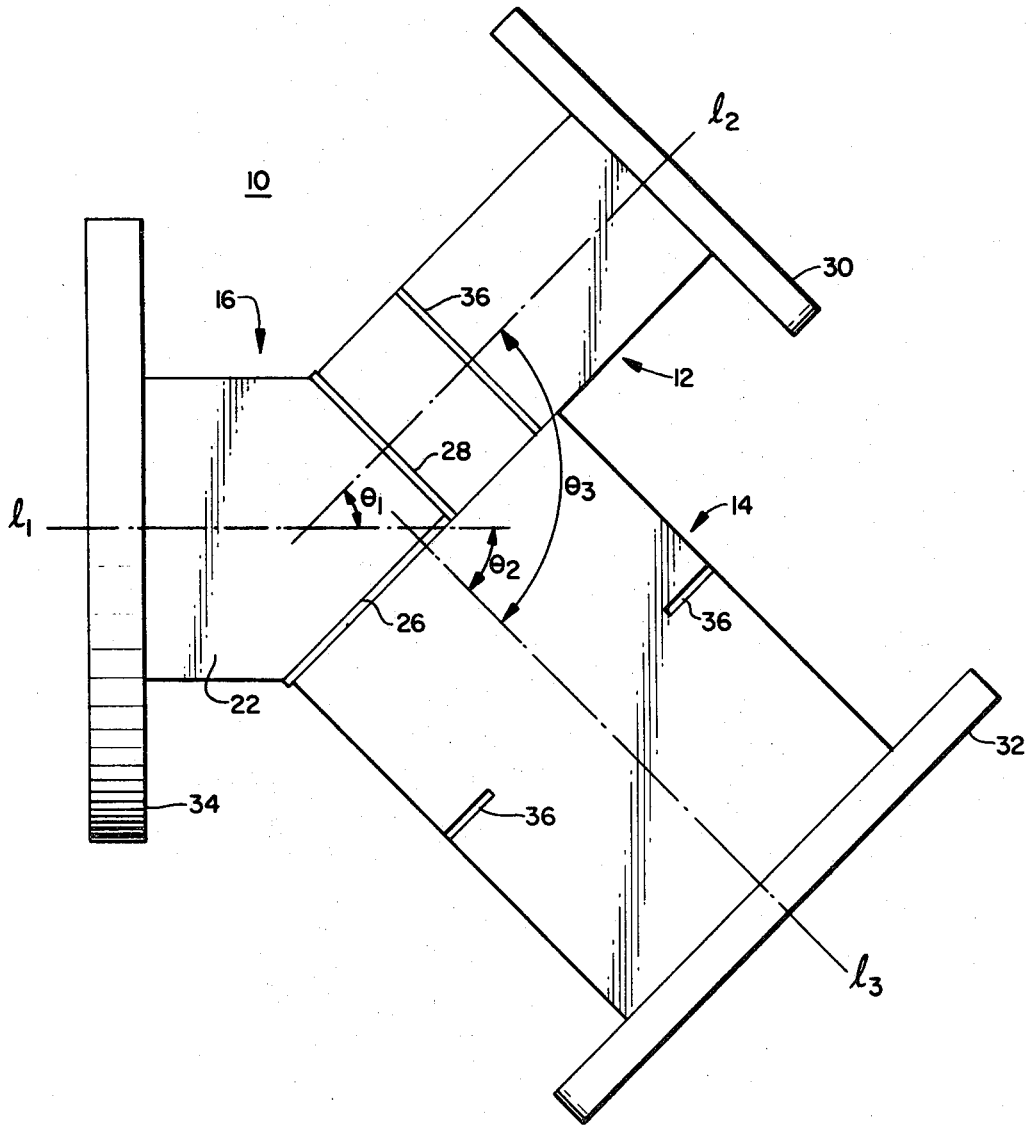
FIG. 1 is a side view of an orthogonal mode transducer in accordance with the present invention.

Referring first to FIG. 1, the Y-configured orthogonal mode transducer 10 of the present invention is shown with the basic elements of first and second rectangular waveguides 12 and 14 coupled to a square central waveguide 16. The rectangular waveguides 12 and 14 are arranged with relation to one another such that the waveguide 12 can support waves which are orthogonal to those in the waveguide 14 but not those which the waveguide 14 can support, and vice versus. The rectangular waveguides 12 and 14 are coupled to the central square waveguide 16 such that both rectangular waveguides feed into the same end of the square waveguide 16. The square waveguide 16 is capable of supporting both of the orthogonal modes found in the rectangular waveguides 12 and 14, respectively.

An important aspect of the Y-configuration of the present invention is that the rectangular arms 12 and 14 are symmetrically arranged relative to the longitudinal axis of the square central waveguide 16. This can be seen from the side view of FIG. 1. Specifically, the longitudinal axis of the square waveguide 16 is shown as $l_1$, while the longitudinal axes of the rectangular waveguides 12 and 14 are shown as $l_2$ and $l_3$, respectively. As shown in FIG. 1, the angle $\theta_1$ between the waveguides 12 and 16 equals the angle $\theta_2$ between waveguides 14 and 16. In the preferred embodiment shown in FIG. 1, this symmetrical relationship is $\theta_1=\theta_2=45°$. Accordingly, the relationship between the rectangular waveguides 12 and 14 themselves is $\theta_3=90°$.

Figure 2:
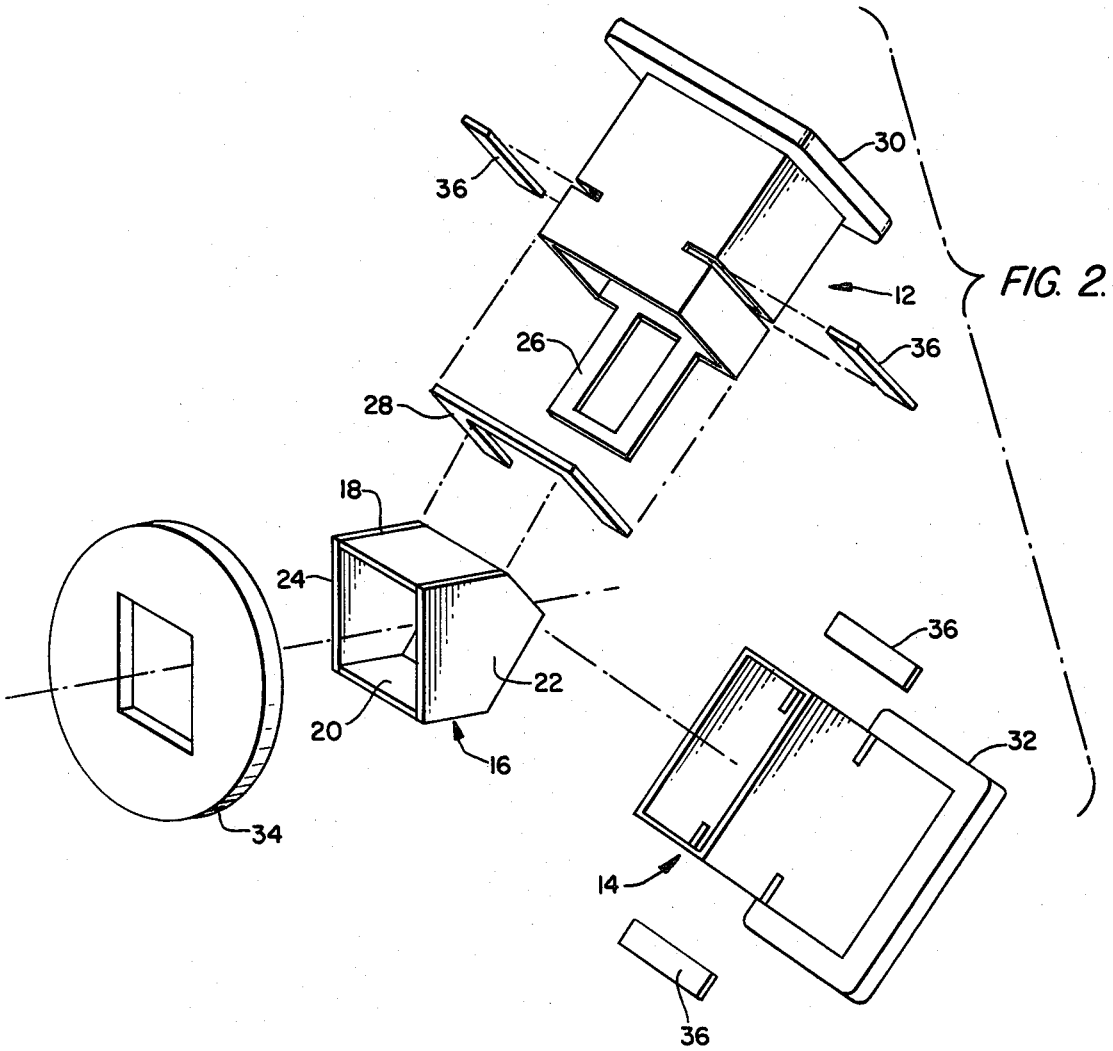
FIG. 2 is an exploded diagram illustrating the components of FIG. 1.

In the embodiment shown in FIGS. 1 and 2, it can be seen that the dimensions of the size of the square waveguide 16 are less than the length of the broad sides of the rectangular waveguides but greater than the length of the narrow sides of the rectangular waveguides (which have dimensions equal to each other). As will be discussed hereinafter, the size of the waveguides is set in accordance with the requirements of the signals to be handled. Therefore, the sides of the square waveguides are not necessarily shorter than the broad dimensions of the rectangular waveguides. However, since the square waveguide dimensions will often be less than the broad dimension of the rectangular waveguides due to the frequencies encountered in satellite communication, this relationship will be described in the preferred embodiment. In any event, because at least some of the dimensions of the rectangular waveguides will differ from those of the square waveguide, particular arrangements must be made for the satisfactory coupling of these waveguides to one another. Effectively, this is accomplished in a straightforward manner in the embodiment shown in FIGS. 1 and 2 by virtue of the 45° relationship of the rectangular waveguides to the square waveguide and the 90° relationship to the rectangular waveguides to one another.

In particular, the square waveguide 16 comprises a top plate 18 and a bottom plate 20 which are generally rectangular. Side plates 22 and 24 of the square waveguide 16, on the other hand, are formed as five-sided plates with the ends to which the rectangular waveguides are to be coupled coming to a sharp point formed by a right angle intersection of two of the five sides. Essentially then, the square waveguide 16 has a first end defining a substantially planar opening and a second end where the side plates 22 and 24 come to a point. This second end presents two planar openings at right angles to each other at the second end of the square waveguide for coupling the rectangular waveguides 12 and 14 thereto.

Because the side dimensions of the square waveguide 16 do not match either the broad or narrow side dimensions of the rectangular waveguides 12 and 14, the respective sides of the various waveguides will, of necessity, overlap ends of the waveguides to which they are coupled. Accordingly, two interface plates 26 and 28 are used to accommodate these overlaps. The first interface plate 26 is actually an extension of one wall of the rectangular waveguide 12, as shown in FIG. 2. The second interface plate 28, on the other hand, is a separate U-shaped piece which is inserted between the rectangular waveguide 12 and the square waveguide 16, as also shown in FIG. 2.

When the orthogonal mode transducer is assembled, the second interface plate 28 is sandwiched between the rectangular waveguide 12 and the square waveguide 16 to match the respective side dimensions to one another. Specifically, the long portion of the interface plate 28 is at least the length of the broad wall of the rectangular waveguide 12. Similarly, the side legs of the interface plate 28 at least match the dimensions of the planar opening in the second end of the square waveguide. Then, by virtue of the plate regions of the interface plate 28 sealing off respective overlaps between the square and rectangular waveguides, the waveguide 12 can be coupled to the waveguide 16 with no leakage of microwaves at the coupling points.

Similarly, when the waveguide 12 is coupled to the square waveguide 16, the interface plate 26 will extend over the other planar opening of the waveguide 16 to which the waveguide 14 is to be coupled. Therefore, when the waveguide 14 is coupled to the square waveguide 16, it will sandwich this interface plate 26 in between. However, unlike the interface 28, it is not necessary for the length of the interface plate 26 to equal the length of the broad side of the rectangular waveguide 14. Instead, when the waveguide 14 is coupled to the square waveguide 16, a portion of the waveguide 14 can extend along the side of the waveguide 12, as shown in FIG. 1. Therefore, the length of the plate 26 need only be that necessary to cover the overlap of one end of the waveguide 14 which extends beyond the planar opening at the second end of the square waveguide 16. The width of the interface plate 26 is set to at least equal the width of the planar opening of 16 to which the waveguide 14 is coupled so that no microwave energy will leak from the coupling point.

In addition to the interface plates 26 and 28 for coupling respective waveguides together, the rectangular waveguides 12 and 14 each have an end flange 30 and 32, respectively. Similarly, the square waveguide 16 has an end flange 34. These end flanges are useful for coupling the orthogonal mode transducer to other waveguide elements. For example, the square waveguide 16 could be coupled to a feed horn (not shown) by way of the end flange 34. In the same manner, the rectangular waveguides 12 and 14 can be coupled to other waveguides (not shown) either for transmitting waves to or receiving them from the waveguides 12 and 14. Also, iris plates 36 can be included in the rectangular waveguides 12 and 14, if desired, to allow for adjustment and matching of the microwave propagation.

An actual example of the dimensions for the orthogonal mode transducer of the present invention will now be given. As mentioned previously, the dimensions of the waveguides themselves must be established in order to carry the desired wavelengths. Accordingly, in order to support a dominant mode $TE_{10}$ signal without introduction of sub-modes in the frequency range between 3.7 GHz and 6.4 GHz (which is a typical satellite communication frequency range) the internal sides of the square waveguide 16 can be dimensioned to be 1.80 inches. To either introduce or extract orthogonal $TE_{10}$ mode signals into or from a square waveguide 16 of this size, the rectangular waveguides 12 and 14 can be standard WR 229 waveguides having dimensions such that the length of the broad side equals 2.290 inches while the length of the narrow side equals 1.145 inches.

In operation with a transmit-receive satellite system, a transmitted frequency of between, for example, 5.9 GHz and 6.4 GHz will be provided with a first polarization on one of the rectangular arms 12 or 14. These signals are fed into the central waveguide 16 and, from there, to a feed horn for transmission to a satellite relay. Received signals from the satellite relay at, for example, frequencies between 3.7 to 4.2 GHz will be fed from the feed horn to the square waveguide 16. These received signals will be directed to the other rectangular waveguide (i.e. the one which was not used for transmission) by virtue of the fact that their polarization is orthogonal to that of the transmitted waves.

The orthogonal mode transducer of the present invention with the dimensions described above can also be used for a receive-only device. An example of this would be a television receive-only system operating between 3.7 GHz and 4.9 GHz. In this case, the signal received will comprise a composite signal of orthogonal components having the same frequency. By virtue of their respective orthogonal polarizations, the rectangular waveguides will separate these orthogonal components from the composite received signal.

Accordingly, the above description sets forth an orthogonal mode transducer capable of effective orthogonal operation in a variety of circumstances. And, as a significant advantage of the present invention, the orthogonal mode transducer can be constructed in a simple manner to form a structurally strong device.

Another advantage of the present configuration is a substantial reduction in size. This is achieved by virtue of the fact that no tapered section is necessary for coupling one rectangular waveguide to the central waveguide. Also, because the rectangular arms are arranged in a Y-configuration, considerably less width is occupied than in a device such as shown in the previously discussed Salzberg patent.

Although the above description has been directed to a particular embodiment using a 45° angle between the rectangular arms and the central waveguide, it is to be understood that other angles could be used to form the Y-configuration. However, the rectangular arms should be symmetrically arranged with respect to the central waveguide to avoid the introduction of undesirable bandwidth limitations. It should be noted that in order to couple the rectangular arms to the central waveguide at angles other than 45°, modifications would have to be made to the angles of the side plates 22 and 24 of the central waveguide to provide openings in the end of the central waveguide at the desired angles. Also, it would sometimes be necessary to provide some modification of the interface plate arrangement to accommodate such different angles.

Also, although the size of the waveguide has been described by way of a particular example, it is to be understood that a variety of waveguide sizes could be used by simple adjustments of the interface plates.

Further, although the central waveguide has been shown as a square waveguide, the system could be readily modified to use a circular central waveguide if desired. Similarly, the present invention is not limited to a square feed horn since it can also be coupled to a circular feed horn. Accordingly, with appropriate conversion of the polarized signals, either linear or circular polarization can be used while still following the principles of the invention. Also, other conventional waveguide devices could readily be coupled to the respective waveguide arms in order to obtain particular signal handling operations.

It is to be understood that the above-described arrangements are simply illustrative of the application of the principles of this invention. Numerous other arrangements may be readily devised by those skilled in the art which embody the principles of the invention and fall within its spirit and scope.

I claim:

1. An orthogonal mode transducer comprising:

a central square waveguide capable of propagating signals having first and second orthogonal polarizations;

a first rectangular waveguide capable of propagating a signal having said first polarization but not a signal having said second polarization; and a second rectangular waveguide capable of propagating a signl having said second polarization but not a signal having said first polarization, wherein said first and second rectangular waveguides are coupled to the central waveguide so that the longitudinal axes of the first and second rectangular waveguides are symmetrically arranged relative to the longitudinal axis of the central waveguide to form a symmetrical Y-configuration, and wherein substantially flat interface plates having length and width dimensions at least as great as lengths of respective sides of the rectangular waveguides are coupled between the rectangular waveguides and the square waveguide at the point where the respective waveguides are coupled together to match the size of the openings at the ends of the rectangular waveguides with the size of the opening at an end of the square waveguide, said interface plates including openings to permit passage of signals between the square and rectangular waveguides.

2. An orthogonal mode transducer as in claim 1, wherein the rectangular waveguides are coupled to the square waveguide so that the longitudinal axes of the first and second rectangular waveguides each form a 45° angle with respect to the longitudinal axis of the central waveguide and a 90° angle with respect to each other.

3. An orthogonal mode transducer as in claim 2, wherein the length of the sides of the square waveguide is smaller than the length of the broad sides of the first and second rectangular waveguides and further wherein the first and second rectangular waveguides are coupled both to each other as well as to the central square waveguide, wherein an end of the second rectangular waveguide which is coupled to the central square waveguide is also coupled along a broad wall of the first rectangular waveguide so that said broad wall of said first rectangular waveguide forms part of the interface plate matching the opening at the end of said second rectangular waveguide with said central square waveguide.

4. An orthogonal mode transducer as in claim 1, wherein all three waveguides are configured so as to be capable of carrying a common dominant mode.

5. An orthogonal mode transducer as in claim 1, wherein the first and second rectangular waveguides include iris control plates extending into said waveguides.

6. An orthogonal mode transducer comprising:

a square central waveguide having a first substantially planar end and a second end having first and second planar openings perpendicular to one another wherein said square central waveguide is capable of propagating signals having first and second orthogonal polarizations;

a first rectangular waveguide coupled to said first planar opening in the second end of said square central waveguide, said first rectangular waveguide being capable of propagating a signal having said first polarization but not a signal having said second polarization; and a second rectangular waveguide coupled to the second planar opening in the second end of said square central waveguide, said second rectangular waveguide being capable of propagating a signal having said second polarization but not a signal having said first polarization, wherein the first and second planar openings are arranged so that the longitudinal axes of the first and second rectangular waveguides will be symmetrical relative to the longitudinal axis of the central square waveguide to thereby form a symmetrical Y-configuration, and wherein the length of the sides of the square central waveguide is smaller than the length of the broad sides of the first and second rectangular waveguides but larger than the length of the narrow sidewalls of the first and second rectangular waveguides, and further comprising interface plates between the ends of the first and second rectangular waveguides and the first and second planar openings in the second end of the square central waveguide to match the rectangular open ends to the planar openings, said interface plates including openings to permit the passage of signals between the square and rectangular waveguides.

7. An orthogonal mode transducer as in claim 6, wherein the rectangular waveguides are coupled to the square waveguide such that the longitudinal axes of the first and second rectangular waveguides each form a 45° angle relative to the longitudinal axis of the central square waveguide and a 90° angle relative to each other.

8. A method of combining first and second signals which are orthogonally polarized relative to one another comprising:

propagating said first signal along a first rectangular waveguide which is not capable of propagating the second signal due to its polarization;

propagating said second signal along a second rectangular waveguide which is not capable of propagating the first signal due to its polarization; and combining said first and second signals to form a composite third signal having both of the orthogonal polarizations of the first and second signals in a common central square waveguide to which said first said second rectangular waveguides are coupled in such a manner that the longitudinal axes of the first and second rectangular waveguides are symmetrically arranged relative to the longitudinal axis of the central waveguide to form a symmetrical Y-configuration, wherein substantially flat interface plates having length and width dimensions at least as great as lengths of respective sides of the rectangular waveguides are coupled between the rectangular waveguides and the square waveguide at the point where the respective waveguides are coupled together to match the size of the openings at the ends of the rectangular waveguides with the size of the opening at an end of the square waveguide, said interface plates including openings to permit passage of signals between the square and rectangular waveguides.

9. A method of separating first and second orthogonal signal components from a composite third signal containing said orthogonal first and second signal components, comprising:

propagating said composite signal along a common central square waveguide capable of carrying both said first and second orthogonal signal components; and separating said first and second orthogonal signal components from one another by coupling the composite signal into a junction formed by said common central waveguide and first and second rectangular waveguides which are coupled to said common central waveguide such that the longitudinal axes of the first and second rectangular waveguides are symmetrically arranged relative to the longitudinal axis of the central waveguide to form a symmetrical Y-configuration, wherein the first rectangular waveguide is configured to be capable of carrying the first orthogonal signal component but not the second orthogonal signal component and the second rectangular waveguide is configured to be capable of carrying the second orthogonal signal component but not the first orthogonal signal component, wherein substantially flat interface plates having length and width dimensions at least as great as lengths of respective sides of the rectangular waveguides are coupled between the rectangular waveguides and the square waveguide at the point where the respective waveguides are coupled together to match the size of the openings at the ends of the rectangular waveguides with the size of the opening at an end of the square waveguide, said interface plates including openings to permit passage of signals between the square and rectangular waveguides.

10. A method of separating transmitted signals from received signals, propagating along a common central square waveguide, wherein the transmitted signals are polarized orthogonally with respect to the received signals, comprising:

propagating the transmitted signals along a first rectangular waveguide capable of supporting the polarization of the transmitted signal but not the polarization of the received signal, and coupling said transmitted signal from said first rectangular waveguide into a first end of the common central waveguide for transmission from a second end of said common central waveguide; and receiving said received signals in said second end of said common central waveguide and coupling them into a second rectangular waveguide which is capable of supporting the polarization of the received signal but not the polarization of the transmitted signal, said second rectangular waveguide being coupled to said first end of said common central waveguide such that the longitudinal axes of the first and second rectangular waveguides are symmetrically arranged relative to the longitudinal axis of the central waveguide to form a symmetrical Y-configuration, wherein substantially flat interface plates having length and width dimensions at least as great as lengths of respective sides of the rectangular waveguides are coupled between the rectangular waveguides and the square waveguide at the point where the respective waveguides are coupled together to match the size of the openings at the ends of the rectangular waveguides with the size of the opening at an end of the square waveguide, said interface plates including openings to permit passage of signals between the square and rectangular waveguides.

11. A method according to claim 10, wherein the transmitted signal has a different frequency than the received signal.

* * * * *